US008570349B2

(12) United States Patent
Kwon et al.

(10) Patent No.: US 8,570,349 B2
(45) Date of Patent: Oct. 29, 2013

(54) METHOD FOR DIVIDING DISPLAY AREA FOR LOCAL DIMMING, LIQUID CRYSTAL DISPLAY DEVICE USING THE SAME, AND METHOD FOR DRIVING THE LIQUID CRYSTAL DISPLAY DEVICE

(75) Inventors: Kyung-Joon Kwon, Seoul (KR); Si-Hoon Lee, Incheon (KR); Jung-Hwan Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 698 days.

(21) Appl. No.: 12/827,537

(22) Filed: Jun. 30, 2010

(65) Prior Publication Data

US 2011/0134151 A1 Jun. 9, 2011

(30) Foreign Application Priority Data

Dec. 7, 2009 (KR) ..... 10-2009-0120841

(51) Int. Cl.
*G09G 5/10* (2006.01)
*G09G 3/36* (2006.01)

(52) U.S. Cl.
USPC ..... 345/690; 345/102

(58) Field of Classification Search
None
See application file for complete search history.

(56) References Cited

U.S. PATENT DOCUMENTS

2009/0079688 A1* 3/2009 Chen et al. ..... 345/102
2009/0273558 A1* 11/2009 Lee ..... 345/102
2009/0303171 A1* 12/2009 Chang et al. ..... 345/102
2010/0103202 A1* 4/2010 Seo et al. ..... 345/690

* cited by examiner

*Primary Examiner* — Joseph Haley
*Assistant Examiner* — Emily Frank
(74) *Attorney, Agent, or Firm* — McKenna Long & Aldridge, LLP

(57) ABSTRACT

A method for dividing a display area for local dimming of LCD is disclosed. The method includes determining an initial number of pixels per data analysis area and a total number of residual pixels, calculating a first residual pixel sum of a current data analysis area using the total number of residual pixels and a second residual pixel sum of a previous data analysis area, determining whether to assign a residual pixel to the current data analysis area using the first residual pixel sum and the total number of data analysis areas, calculating a second residual sum of the current data analysis area whether to assign a residual pixel, and repeating the calculation above until the data analysis area index is a last data analysis area index.

21 Claims, 6 Drawing Sheets

METHOD FOR DIVIDING DISPLAY AREA FOR LOCAL DIMMING, LIQUID CRYSTAL DISPLAY DEVICE USING THE SAME, AND METHOD FOR DRIVING THE LIQUID CRYSTAL DISPLAY DEVICE

This application claims the benefit of Korean Patent Application No. 10-2009-0120841, filed on Dec. 7, 2009, which is hereby incorporated by reference as if fully set forth herein.

BACKGROUND OF THE INVENTION

1. Field of the Invention

The present invention relates to a Liquid Crystal Display (LCD) device, and more particularly, to a method for dividing a display area to minimize an error between a local dimming block of backlight unit for local dimming and a data analysis area, and an LCD device using the same.

2. Discussion of the Related Art

Recently, flat panel displays have been popular as video displays, such as LCDs, Plasma Display Panels (PDPs), Organic Light Emitting Diodes (OLEDs), etc.

An LCD device includes a liquid crystal panel for displaying an image on a pixel matrix relying on the electrical and optical characteristics of liquid crystals that exhibit anisotropy in dielectric constant and refractive index, a driving circuit for driving the liquid crystal panel, and a backlight unit for irradiating light onto the liquid crystal panel. The gray scale of each pixel is adjusted by controlling the transmittance of light that passes from the backlight unit through the liquid crystal panel and polarizers through changing the orientation of liquid crystals according to a data signal.

In the LCD device, the luminance of each pixel is determined by the product between the luminance of the backlight unit and the light transmittance of liquid crystals that depends on data. The LCD device employs backlight dimming method for the purposes of increasing a contrast ratio and reducing power consumption. The backlight dimming method analyzes input image data and then modulates the image data and adjust a dimming value, for controlling the luminance of the backlight unit, according to the analyzed result. A Light Emitting Diode (LED) backlight unit using LEDs as a light source has recently been used. The LEDs boast of high luminance and low power consumption, compared to conventional lamps. Because the LED backlight unit allow for location-based control, they may be driven by local dimming. According to the local dimming technology, the LED backlight unit is divided into a plurality of light emitting blocks and luminance is controlled on a bock-by-block basis. Local dimming may further increase the contrast ratio and decrease the power consumption since the backlight unit and the liquid crystal panel are divided into a plurality of blocks, local dimming values are decided by analyzing data on a block basis, and data is compensated based on the local dimming values.

Because local dimming is a technique that controls the luminance of backlight unit by analyzing data on a local dimming block basis, an error between a local dimming block of a backlight unit and a data analysis area of a display area brings about a dimming deviation between local dimming blocks. The resulting luminance deviation degrades image quality. To prevent the error between a local dimming block and a data analysis area, a design constraint is imposed that the number of equally divided local dimming blocks should be a factor of "resolution/number of backlight driving ports" so that each local dimming block includes the same number of pixels. However, when a backlight unit is designed in terms of slimming down of the backlight unit or reduction of fabrication cost, it is difficult to satisfy the constraint that the number of local dimming blocks should be a factor of "resolution/number of backlight driving ports".

Meanwhile, if the number of local dimming blocks is set to be a number other than any factor of "resolution/number of backlight driving ports", there exist residual pixels that cannot be equally distributed to the local dimming blocks. For example, in an LCD device having a liquid crystal panel with a resolution of 1920 (the number of horizontal pixels)×1080 (the number of vertical pixels) and having a backlight unit that is driven in parallel through four ports, if an LED array is designed with 18 horizontal local dimming blocks, the number of horizontal pixels for a data analysis area corresponding to each local dimming block is "480/18=26.67". Herein, 480=1920/4. When the number of horizontal pixels for a data analysis area corresponding to each local dimming block is set to an integer, i.e. 26, a data analysis area corresponding to the last local dimming block includes additional 12 residual pixels. Herein, 12=480−(26×18). Therefore, a data analysis area corresponding to each of the first 17 local dimming blocks among the 18 local dimming blocks has 26 horizontal pixels, whereas a data analysis area corresponding to the last 18th local dimming block includes 38 (=26+12) horizontal pixels. An error occurs between a plurality of local dimming blocks and their corresponding data analysis areas as well as between the last local dimming block and its corresponding data analysis area. The resulting luminance deviation caused by a dimming deviation between local dimming blocks degrades image quality.

SUMMARY OF THE INVENTION

Accordingly, the present invention is directed to a method for dividing a display area, a Liquid Crystal Display (LCD) device using the same, and a method for driving the LCD device that substantially obviate one or more problems due to limitations and disadvantages of the related art.

An object of the present invention is to provide a method for dividing a display area to minimize errors between local dimming blocks of backlight unit for local dimming and data analysis areas by distributing residual pixels, an LCD device using the same, and a method for driving the LCD device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for dividing a display area for local dimming includes determining an initial number of pixels per data analysis area and a total number of residual pixels using a resolution of the display area and a total number of data analysis areas equal to a total number of local dimming areas of a backlight unit, calculating a first residual pixel sum of a current data analysis area by adding the total number of residual pixels to a second residual pixel sum of a previous data analysis area, each time a data analysis area index increases, comparing the first residual pixel sum of the current data analysis area with the total number of data analysis areas and determining whether to assign a residual pixel to the current data analysis area according to a result of the comparison, calculating a second residual sum of the current data analysis area by subtracting the total number of data analysis areas from the first residual pixel sum of the current data analysis area and outputting the second residual sum of the current data analysis area as the second residual sum of the previous data analysis area for a next data analysis area, if a residual pixel is assigned to the current data analysis area, setting the first residual sum of the current data analysis area as the second residual sum of the current data analysis area and outputting the second residual sum of the current data analysis area as the second residual sum of the previous data analysis area for the next data analysis area, if a residual pixel is not assigned to the current data analysis area, and repeating the calculation of a first residual pixel sum of a current data analysis area, the determination as to whether to assign a residual pixel to the current data analysis area, and the outputting of a second residual pixel sum of the current data analysis area, until the data analysis area index is a last data analysis area index.

For the determination of an initial number of pixels per data analysis area and a total number of residual pixels, an integer obtained by dividing the resolution by the total number of data analysis areas may be determined as the initial number of pixels per data analysis area, and the total number of residual pixels may be determined by calculating "the resolution−(the initial number of pixels per data analysis area)×(the total number of data analysis areas)".

If the backlight unit is driven in parallel through a plurality of ports, the total number of residual pixels may be determined by calculating "(the resolution/a number of the ports)−(the initial number of pixels per data analysis area)×(the total number of data analysis areas)".

For the calculation of a first residual pixel sum of a current data analysis area, the first residual pixel sum of the current data analysis area may be calculated by adding the total number of residual pixels to the second residual pixel sum of the previous data analysis area.

For the determination as to whether to assign a residual pixel to the current data analysis area, one residual pixel may be distributed to the current data analysis area, if the first residual pixel sum of the current data analysis area is larger than the total number of data analysis areas, and a final number of pixels in the current data analysis area may be determined by adding one to the initial number of pixels per data analysis areas.

For the determination as to whether to assign a residual pixel to the current data analysis area, the final number of pixels in the current data analysis may be determined as the initial number of pixels per data analysis areas without assigning a residual pixel to the current data analysis area, if the first residual pixel sum of the current data analysis area is equal to or smaller than the total number of data analysis areas.

The determination of an initial number of pixels per data analysis area and a total number of residual pixels, the calculation of a first residual pixel sum of a current data analysis area, the determination as to whether to assign a residual pixel to the current data analysis area, the outputting of a second residual pixel sum of the current data analysis area, and the repetition may be performed for each of horizontal and vertical resolutions of the resolution of the display area, and one residual pixel may be assigned to each of as many data analysis areas as the total number of residual pixels, among the data analysis areas.

In another aspect of the present invention, a method for driving an LCD device includes analyzing data on a data analysis area basis using information about the data analysis areas set by the method for dividing a display area, modulating the data on a data analysis area basis according to a result of the analysis, and determining a local dimming value for each of the local dimming blocks according to the result of the analysis.

In another aspect of the present invention, an LCD device includes a backlight unit for projecting light, a liquid crystal panel for displaying an image using the light received from the backlight unit, a local dimming driver for analyzing data on a data analysis area basis using information about the data analysis areas set by the method for dividing a display area, modulating the data on a data analysis area basis according to a result of the analysis, and determining a local dimming value for each of the local dimming blocks according to the result of the analysis, a panel driver for outputting the data received from the local dimming driver to the liquid crystal panel, and a backlight driver for controlling luminance of the backlight unit on a local dimming block basis according to the local dimming value of each local dimming block received from the local dimming driver.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
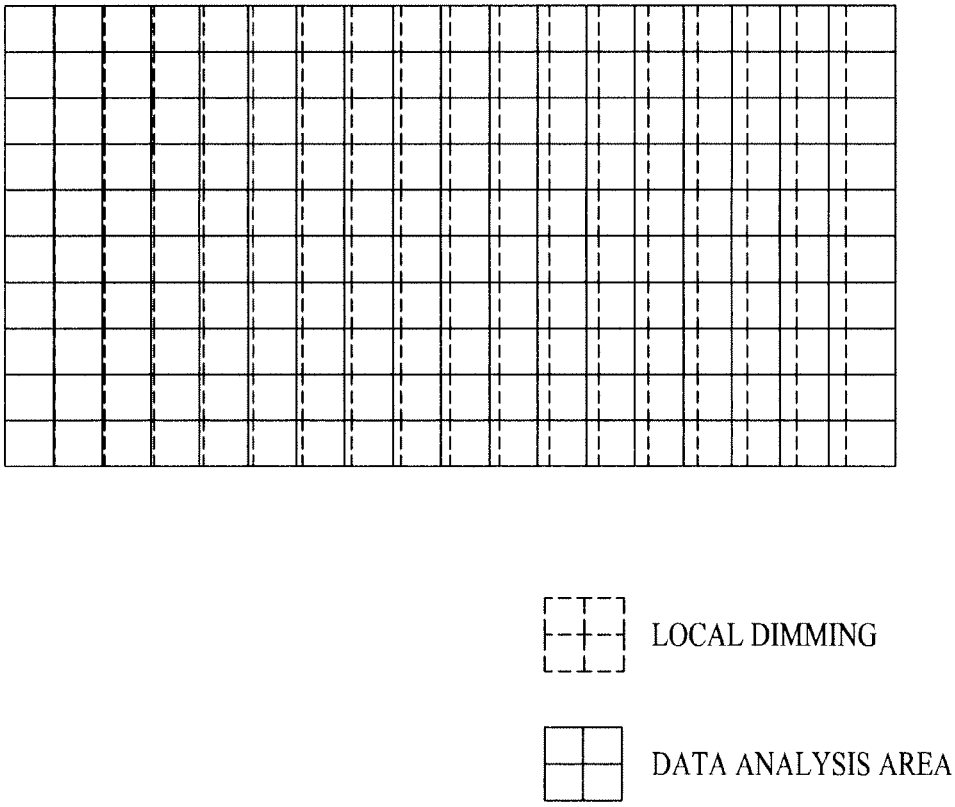
FIG. 1 Related Art
FIG. 1 illustrates errors between local dimming blocks and data analysis areas, encountered with the related art.
Figure 2:
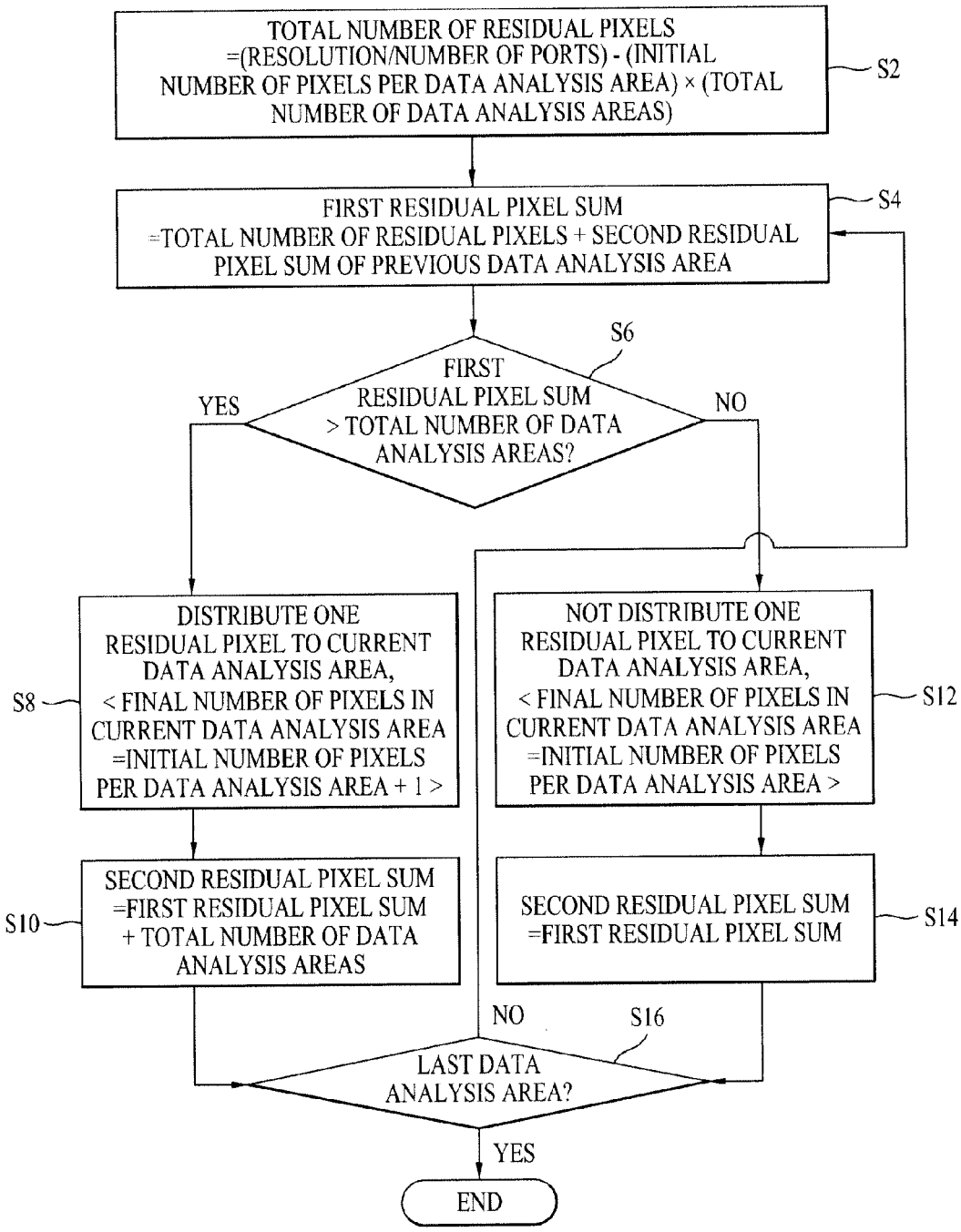
FIG. 2 is a flowchart illustrating a method for dividing a display area for local dimming according to an exemplary embodiment of the present invention.

FIG. 2 is a flowchart illustrating a method for dividing a display area for local dimming according to an exemplary embodiment of the present invention.

Referring to FIG. 2, in step S2, the number of residual pixels to be distributed is determined using the resolution of the display area, the total number of data analysis areas (i.e. the number of segments into which the display area is divided) equal to a designer-intended number of local dimming areas of a backlight unit (i.e. the number of segments into which the backlight unit is divided), and an initial number of pixels per data analysis area calculated by dividing the resolution by the total number of data analysis areas. Specifically, the initial number of pixels per data analysis area is determined by dividing the horizontal or vertical resolution of the display area by the designer-intended total number of data analysis areas and taking only the resulting integer (i.e. the quotient), while discarding the remainder below the decimal point. Then the total number of residual pixels to be distributed is calculated by "resolution−(initial number of pixels per data analysis area)×(total number of data analysis areas)" according to [Equation 1].

Total number of residual pixels=Resolution−(initial number of pixels per data analysis area)×(total number of data analysis areas) [Equation 1]

If the backlight unit is driven in parallel through a plurality of ports (channels), the total number of residual pixels to be distributed is calculated by "(resolution/number of ports)−(initial number of pixels per data analysis area)×(total number of data analysis areas)" according to [Equation 2].

Total number of residual pixels=(resolution/number of ports)−(initial number of pixels per data analysis area)×(total number of data analysis areas) [Equation 2]

For example, if a liquid crystal panel has a resolution of 1920 (horizontal)×1080 (vertical), a backlight unit is driven in parallel through four ports, and a designer wants to divide a display area in a horizontal direction into 18 data analysis areas corresponding to preset 18 local dimming blocks, 12 residual pixels need to be distributed by calculating "(resolution/number of ports)−(initial number of pixels per data analysis area)×(total number of data analysis areas)=(1920/4)−(26×18)=12)".

In step S4, each time the index of a data analysis area increases, a first residual pixel sum for a current data analysis area is calculated by adding a second residual pixel sum of the previous data analysis area to the total number of residual pixels according to [Equation 3].

First residual pixel sum of current analysis area=(total number of residual pixels)+(second residual pixel sum of previous data analysis area) [Equation 3]

There is no previous data analysis area for the first data analysis area. In this case, the first residual pixel number of the first data analysis area is calculated by adding the total number of residual pixels used as the second residual pixel sum to the total number of residual pixels. For instance, when the total number of residual pixels is 12, the first residual pixel sum of the first data analysis area is "12+12=24".

In step S6, the first residual pixel sum of the current data analysis area is compared with the total number of data analysis areas and it is determined according to the result of the comparison whether to distribute one residual pixel to the current data analysis area.

To be more specific, the first residual pixel sum of the current data analysis area is compared with the total number of data analysis areas in step S6. If the first residual pixel sum is larger than the total number of data analysis areas, one residual pixel is distributed to the current data analysis area in step S8. Thus the final number of pixels of the current data analysis area is determined by adding one residual pixel to the initial number of pixels per data analysis area according to [Equation 4].

Final number of pixels in current data analysis area=(initial number of pixels per data analysis area)+1 [Equation 4]

Then the second residual pixel sum of the current data analysis area is calculated by subtracting the total number of data analysis areas from the first residual pixel sum of the current data analysis area by [Equation 5] in step S10.

Second residual pixel sum of current data analysis area=(first residual pixel sum of current data analysis area)−(total number of data analysis areas) [Equation 5]

On the contrary, if the first residual pixel sum of the current data analysis area is equal to or less than the total number of data analysis areas in step S6, the final number of pixels in the current data analysis area is set to the initial number of pixels per data analysis area as illustrated in [Equation 6].

Final number of pixels in current data analysis area=initial number of pixels per data analysis area [Equation 6]

In step S14, the first residual pixel sum of the current data analysis area is output as the second residual pixel sum of the current data analysis area according to [Equation 7].

Second residual pixel sum of current data analysis area=first residual pixel sum of current data analysis area [Equation 7]

In step S16, unless the current data analysis area is the last one, the second residual pixel sum of the current data analysis area outputs in step S10 or S14 is provided into the step S4 for the next data analysis area. Then for the next data analysis area, steps S4 to S16 are repeated to thereby determine whether to distribute one residual pixel to the next data analysis area. In this manner, residual pixels can be uniformly distributed, one to each of a plurality of data analysis areas by repeating steps S4 to S16 until the current data analysis area is the last one. As residual pixels are distributed by adding one residual pixel to each of as many data analysis areas as the total number of residual pixels detected in step S2, errors between local dimming blocks and data analysis areas can be minimized.

Figure 3:
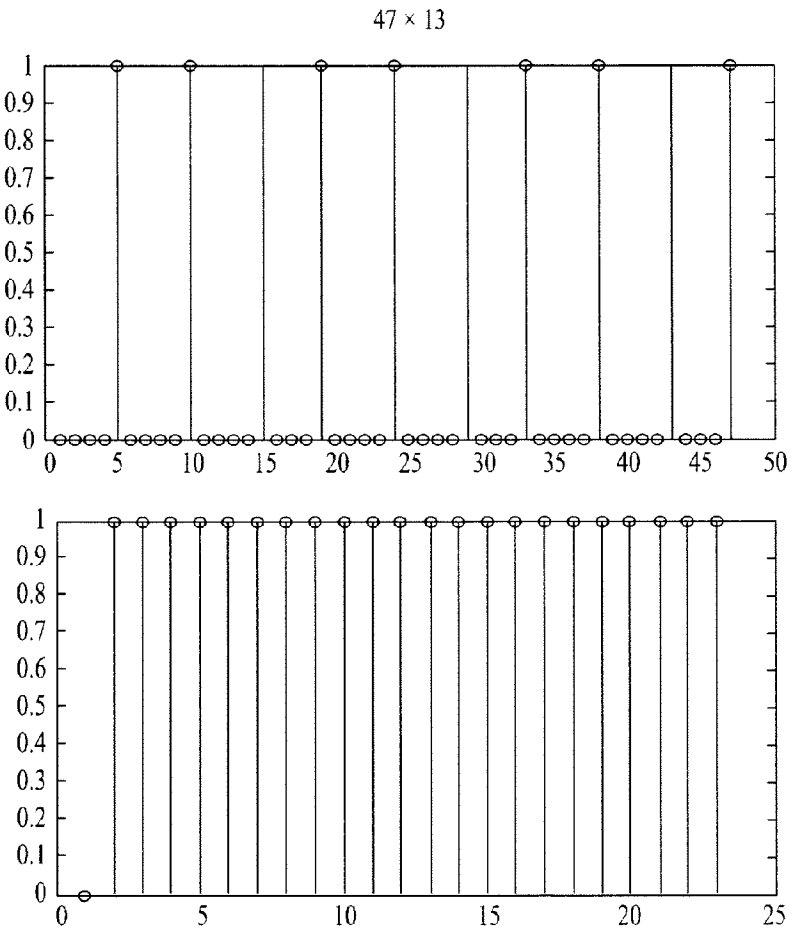
FIG. 3 illustrates an exemplary result of distributing residual pixels according to the display area dividing method illustrated in FIG. 2.
Figure 4:
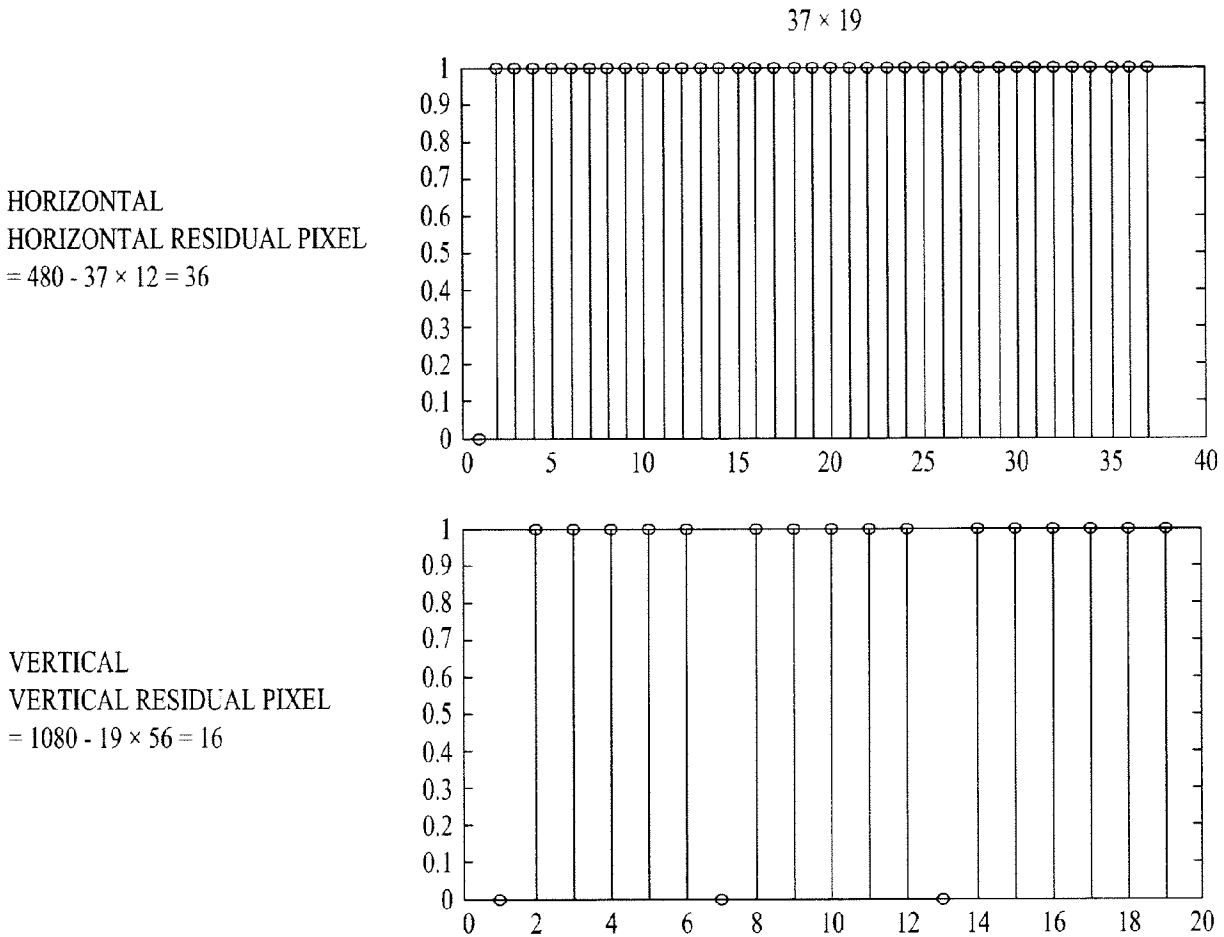
FIG. 4 illustrates another exemplary result of distributing residual pixels according to the display area dividing method illustrated in FIG. 2.
Figure 5:
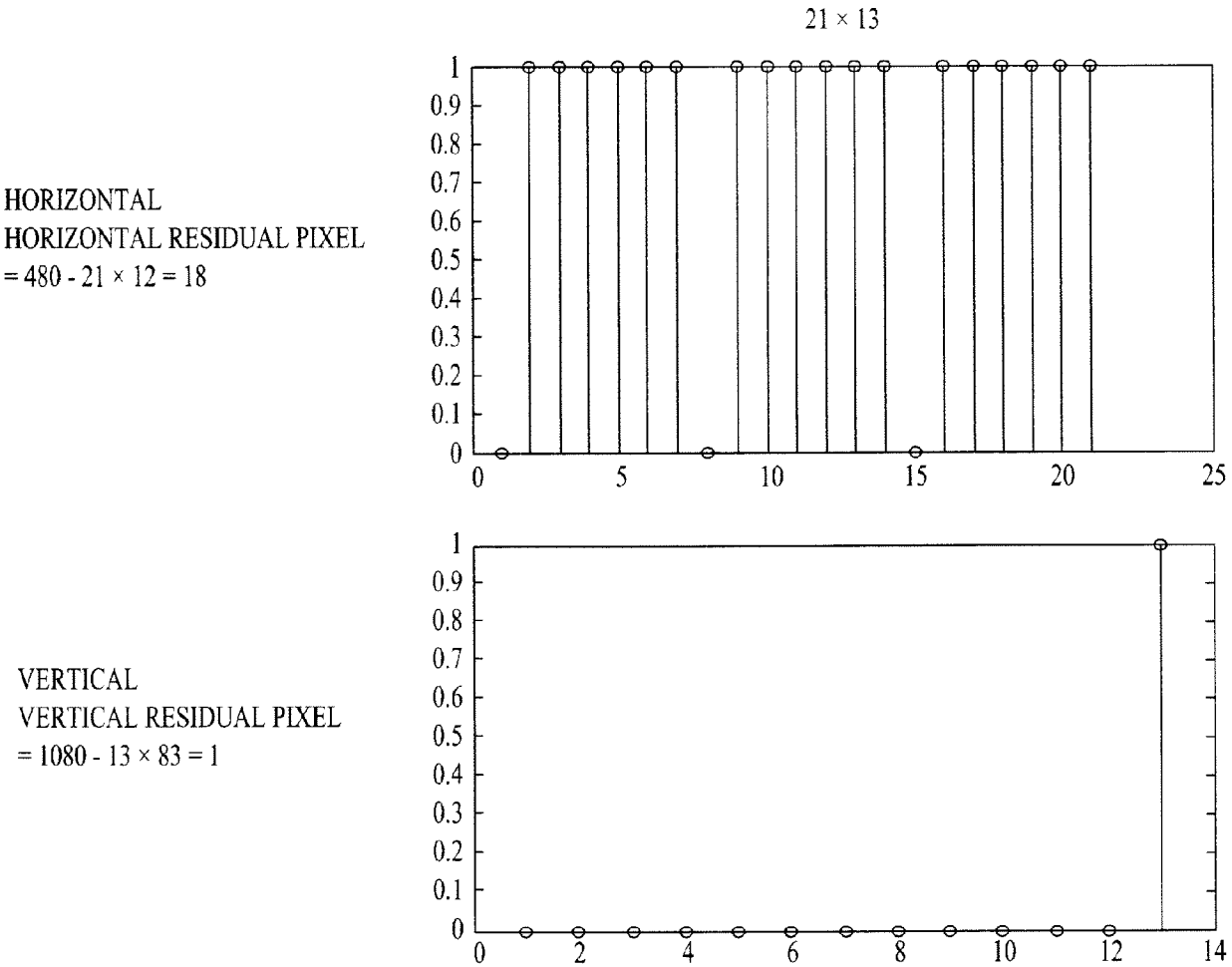
FIG. 5 illustrates a further exemplary result of distributing residual pixels according to the display area dividing method illustrated in FIG. 2.

FIGS. 3, 4 and 5 illustrate cases of distributing residual pixels according to the display area division method illustrated in FIG. 2.

In the illustrated cases of FIGS. 3, 4 and 5, the maximum size of a data analysis area is "60×30," the resolution of a display area is "1920×1080," and a backlight unit is driven through four ports, by way of example. A data analysis area to which one residual pixel is added is marked with "o" above the data analysis area, and a data analysis area to which one residual pixel is not added is marked with "o" below the data analysis area.

Referring to FIG. 3, when the display area with the resolution of "1920×1080" is divided into "47×23" data analysis areas, the total number of horizontal residual pixels is "(1920/4)−47×10=10" and the total number of vertical residual pixels is "1080−23×46=22". The 10 horizontal residual pixels are distributed by assigning one residual pixel to each of as many horizontal data analysis areas as the horizontal residual pixels, that is, 10 horizontal data analysis areas among the 47 horizontal data analysis areas and the 22 vertical residual pixels are also distributed in the same manner by assigning one residual pixel to each of 22 vertical data analysis areas among the 23 vertical data analysis areas, according to the distribution method illustrated in FIG. 2.

Referring to FIG. 4, when the display area with the resolution of "1920×1080" is divided into "37×19" data analysis areas, the total number of horizontal residual pixels is "(1920/4)−37×12=36" and the total number of vertical residual pixels is "1080−19×56=16". The 36 horizontal residual pixels are distributed by assigning one residual pixel to each of as many horizontal data analysis areas as the horizontal residual pixels, that is, 36 horizontal data analysis areas among the 37 horizontal data analysis areas and the 16 vertical residual pixels are also distributed in the same manner by assigning one residual pixel to each of 16 vertical data analysis areas among the 19 vertical data analysis areas.

Referring to FIG. 5, when the display area with the resolution of "1920×1080" is divided into "21×13" data analysis areas, the total number of horizontal residual pixels is "(1920/4)−21×12=18" and the total number of vertical residual pixels is "1080−13×83=1". The 18 horizontal residual pixels are distributed by assigning one residual pixel to each of as many horizontal data analysis areas as the horizontal residual pixels, that is, 18 horizontal data analysis areas among the 21 horizontal data analysis areas and the one vertical residual pixel is assigned to one vertical data analysis area among the 13 vertical data analysis areas.

Figure 6:
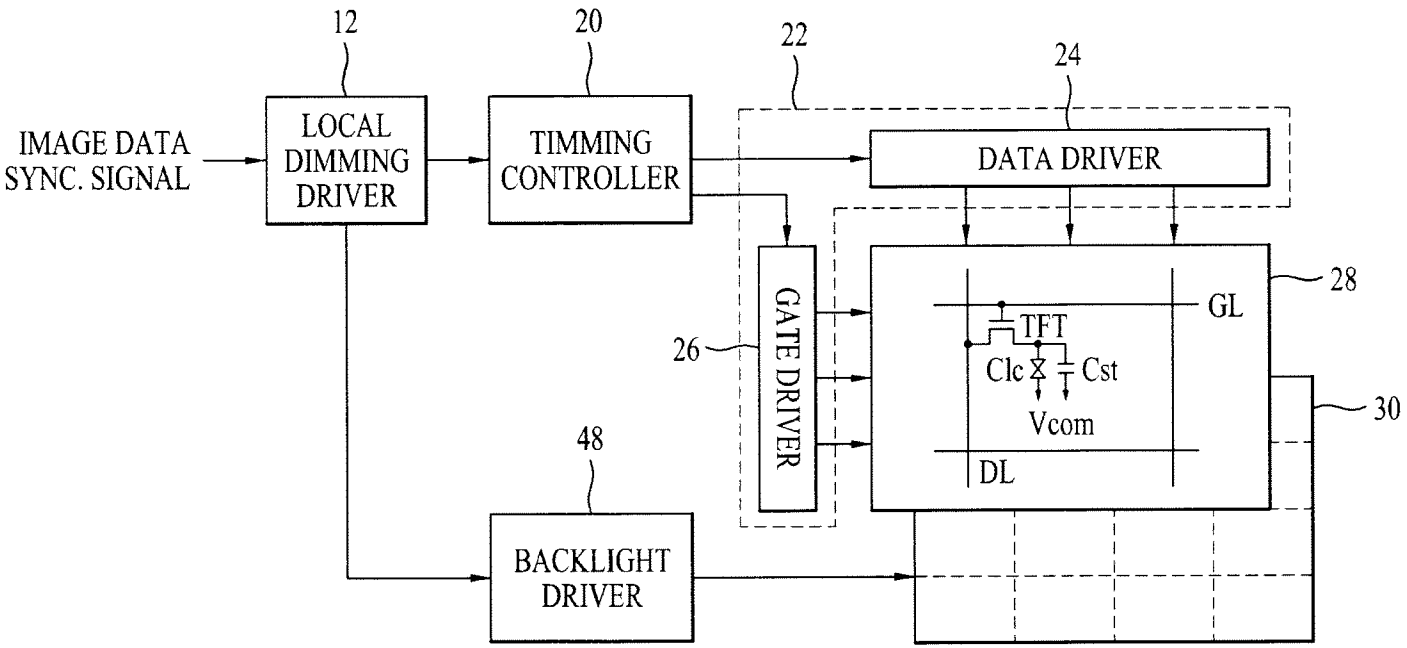
FIG. 6 is a diagram of a Liquid Crystal Display (LCD) device according to an exemplary embodiment of the present invention.

FIG. 6 is a schematic block diagram of an LCD device according to an exemplary embodiment of the present invention.

Referring to FIG. 6, the LCD device includes a local dimming driver 12 for modulating data and determining a local dimming value for each block by analyzing input image data on a block basis, a timing controller 20 for providing the data received from the local dimming driver 12 to a panel driver 22 and controlling a driving timing of the panel driver 22, a backlight driver 18 for driving an LED backlight unit 30 on a block basis based on the local dimming value of each block received from the local dimming driver 10, and a liquid crystal panel 28 driven by the panel driver 22, including a data driver 24 and a gate driver 26. The local dimming driver 12 may be provided inside the timing controller 20.

In operation, the local dimming driver 12 analyzes input image data for each of a plurality of data analysis areas corresponding to a plurality of local dimming blocks using synchronization signals, and modulates the data on a data analysis area basis, while determining a local dimming value for each block, according to the analysis result. Specifically, the local dimming driver 12 stores information about the positions of data analysis areas to which residual pixels are uniformly distributed using the display area division method illustrated in FIG. 2. Since the local dimming driver 12 analyzes the data on a data analysis area basis based on the position information about each data analysis area, errors between data analysis areas and local dimming blocks can be minimized.

The timing controller 20 arranges the data received from the local dimming driver 12 and outputs the arranged data to the data driver 24 of the panel driver 22. The timing controller 20 generates data control signals for controlling driving timings of the data driver 24 and gate control signals for controlling driving timings of the gate driver 26, using a plurality of synchronization signals received from the local dimming driver 12, specifically a vertical synchronization signal, a horizontal synchronization signal, a data enable signal, and a dot clock signal, and outputs the data control signals and the gate control signals respectively to the data driver 24 and the gate driver 26. Meanwhile, the timing controller 20 may further include an overdriving circuit (not shown) for modulating the data by applying an overshoot value or an undershoot value to the data according to a data difference between successive frames in order to increase the response speed of liquid crystals.

The panel driver 22 includes the data driver 24 for driving data lines DL of the liquid crystal panel 28 and gate lines GL of the liquid crystal panel 28.

The data driver 24 converts digital video data received from the timing controller 24 to analog data signals (pixel voltage signals) using gamma voltages in response to the data control signals received from the timing controller 20 and provides the analog data signals to the data lines DL of the liquid crystal panel 28.

The gate driver 26 sequentially drives the gate lines GL of the liquid crystal panel 28 in response to the gate control signals received from the timing controller 20.

The liquid crystal panel 28 displays an image through a pixel matrix having a plurality of pixels arranged. Each pixel represents a desired color by combining red, green and blue sub-pixels that control light transmittance through changing the orientation of the liquid crystals according to a luminance-compensated data signal. Each of the sub-pixels includes a Thin Film Transistor (TFT) connected to a gate line GL and a data line DL, and a liquid crystal capacitor Clc and a storage capacitor Cst that are connected to the TFT in parallel. The liquid crystal capacitor Clc is charged with a different voltage between a data signal supplied to a pixel electrode through the TFT and a common voltage Vcom supplied to a common electrode and drives a liquid crystal according to the charged voltage, to thereby control light transmittance. The storage capacitor Cst maintains the voltage charged at the liquid crystal capacitor Clc to be stable.

The backlight driver 18 drives the LED backlight unit 30 on a block basis according to the local dimming value of each block received from the local dimming driver 12, thus controlling the luminance of the LED backlight unit 30 on a block basis. The backlight driver 18 generates a Pulse Width Modulation (PWM) signal with a duty ratio corresponding to the local dimming value of each block on a block basis and provides an LED driving signal corresponding to the PWM signal for each block to the block, thereby driving the LED backlight unit 30 on a block basis.

As is apparent from the above description, the method for dividing a display area for local dimming, the LCD device using the same, and the method for driving the LCD device according to the present invention distribute residual pixels by assigning one residual pixel to each of as many data analysis areas as the total number of residual pixels. Therefore, errors between local dimming blocks and data analysis areas are minimized and thus the degradation of image quality caused by the resulting dimming deviation is minimized.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for dividing a display area for local dimming, comprising:

determining an initial number of pixels per data analysis area and a total number of residual pixels using a resolution of the display area and a total number of data analysis areas equal to a total number of local dimming areas of a backlight unit;

calculating a first residual pixel sum of a current data analysis area by adding the total number of residual pixels to a second residual pixel sum of a previous data analysis area, each time a data analysis area index increases;

comparing the first residual pixel sum of the current data analysis area with the total number of data analysis areas and determining whether to assign a residual pixel to the current data analysis area according to a result of the comparison;

calculating a second residual sum of the current data analysis area by subtracting the total number of data analysis areas from the first residual pixel sum of the current data analysis area and outputting the second residual sum of the current data analysis area as the second residual sum of the previous data analysis area for a next data analysis area, if a residual pixel is assigned to the current data analysis area;

setting the first residual sum of the current data analysis area as the second residual sum of the current data analysis area and outputting the second residual sum of the current data analysis area as the second residual sum of the previous data analysis area for the next data analysis area, if a residual pixel is not assigned to the current data analysis area; and repeating the calculation of a first residual pixel sum of a current data analysis area, the determination as to whether to assign a residual pixel to the current data analysis area, and the outputting of a second residual pixel sum of the current data analysis area, until the data analysis area index is a last data analysis area index, wherein the determination of an initial number of pixels per data analysis area and a total number of residual pixels comprises:

determining an integer obtained by diving the resolution by the total number of data analysis areas as the initial number of pixels per data analysis area; and determining the total number of residual pixels by calculating "the resolution-(the initial number of pixels per data analysis area)×(the total number of data analysis areas)".

2. The method according to claim 1, wherein if the backlight unit is driven in parallel through a plurality of ports, the determination of the total number of residual pixels comprises determining the total number of residual pixels by calculating "(the resolution/a number of the ports)-(the initial number of pixels per data analysis area)×(the total number of data analysis areas)".

3. The method according to claim 2, wherein the calculation of a first residual pixel sum of a current data analysis area comprises calculating the first residual pixel sum of the current data analysis area by adding the total number of residual pixels to the second residual pixel sum of the previous data analysis area.

4. The method according to claim 3, wherein the determination as to whether to assign a residual pixel to the current data analysis area comprises:

distributing one residual pixel to the current data analysis area, if the first residual pixel sum of the current data analysis area is larger than the total number of data analysis areas; and determining a final number of pixels in the current data analysis area by adding one to the initial number of pixels per data analysis areas.

5. The method according to claim 4, wherein the determination as to whether to assign a residual pixel to the current data analysis area further comprises:

determining the final number of pixels in the current data analysis as the initial number of pixels per data analysis areas without assigning a residual pixel to the current data analysis area, if the first residual pixel sum of the current data analysis area is equal to or smaller than the total number of data analysis areas.

6. The method according to claim 5, wherein the determination of an initial number of pixels per data analysis area and a total number of residual pixels, the calculation of a first residual pixel sum of a current data analysis area, the determination as to whether to assign a residual pixel to the current data analysis area, the outputting of a second residual pixel sum of the current data analysis area, and the repetition are performed for each of horizontal and vertical resolutions of the resolution of the display area.

7. The method according to claim 6, wherein one residual pixel is assigned to each of as many data analysis areas as the total number of residual pixels, among the data analysis areas.

8. A method for driving a Liquid Crystal Display (LCD) device, comprising analyzing data on a data analysis area basis using information about the data analysis areas set by a method for dividing a display area for local dimming modulating the data on a data analysis area basis according to a result of the analysis, and determining a local dimming value for each of the local dimming blocks according to the result of the analysis, wherein the method for dividing a display area for local dimming, comprises:

determining an initial number of pixels per data analysis area and a total number of residual pixels using a resolution of the display area and a total number of data analysis areas equal to a total number of local dimming areas of a backlight unit;

calculating a first residual pixel sum of a current data analysis area by adding the total number of residual pixels to a second residual pixel sum of a previous data analysis area, each time a data analysis area index increases;

comparing the first residual pixel sum of the current data analysis area with the total number of data analysis areas and determining whether to assign a residual pixel to the current data analysis area according to a result of the comparison;

calculating a second residual sum of the current data analysis area by subtracting the total number of data analysis areas from the first residual pixel sum of the current data analysis area and outputting the second residual sum of the current data analysis area as the second residual sum of the previous data analysis area for a next data analysis area, if a residual pixel is assigned to the current data analysis area;

setting the first residual sum of the current data analysis area as the second residual sum of the current data analysis area and outputting the second residual sum of the current data analysis area as the second residual sum of the previous data analysis area for the next data analysis area, if a residual pixel is not assigned to the current data analysis area; and repeating the calculation of a first residual pixel sum of a current data analysis area, the determination as to whether to assign a residual pixel to the current data analysis area, and the outputting of a second residual pixel sum of the current data analysis area, until the data analysis area index is a last data analysis area index, wherein the determination of an initial number of pixels per data analysis area and a total number of residual pixels comprises:

determining an integer obtained by diving the resolution by the total number of data analysis areas as the initial number of pixels per data analysis area; and determining the total number of residual pixels by calculating "the resolution-(the initial number of pixels per data analysis area)×(the total number of data analysis areas)".

9. The method according to claim 8, wherein if the backlight unit is driven in parallel through a plurality of ports, the determination of the total number of residual pixels comprises determining the total number of residual pixels by calculating "(the resolution/a number of the ports)−(the initial number of pixels per data analysis area)×(the total number of data analysis areas)".

10. The method according to claim 9, wherein the calculation of a first residual pixel sum of a current data analysis area comprises calculating the first residual pixel sum of the current data analysis area by adding the total number of residual pixels to the second residual pixel sum of the previous data analysis area.

11. The method according to claim 10, wherein the determination as to whether to assign a residual pixel to the current data analysis area comprises:

distributing one residual pixel to the current data analysis area, if the first residual pixel sum of the current data analysis area is larger than the total number of data analysis areas; and determining a final number of pixels in the current data analysis area by adding one to the initial number of pixels per data analysis areas.

12. The method according to claim 11, wherein the determination as to whether to assign a residual pixel to the current data analysis area further comprises:

determining the final number of pixels in the current data analysis as the initial number of pixels per data analysis areas without assigning a residual pixel to the current data analysis area, if the first residual pixel sum of the current data analysis area is equal to or smaller than the total number of data analysis areas.

13. The method according to claim 12, wherein the determination of an initial number of pixels per data analysis area and a total number of residual pixels, the calculation of a first residual pixel sum of a current data analysis area, the determination as to whether to assign a residual pixel to the current data analysis area, the outputting of a second residual pixel sum of the current data analysis area, and the repetition are performed for each of horizontal and vertical resolutions of the resolution of the display area.

14. The method according to claim 13, wherein one residual pixel is assigned to each of as many data analysis areas as the total number of residual pixels, among the data analysis areas.

15. An Liquid Crystal Display (LCD) device, comprising:

a backlight unit for projecting light;

a liquid crystal panel for displaying an image using the light received from the backlight unit;

a local dimming driver for analyzing data on a data analysis area basis using information about the data analysis areas set by a method for dividing a display area for local dimming, modulating the data on a data analysis area basis according to a result of the analysis, and determining a local dimming value for each of the local dimming blocks according to the result of the analysis;

a panel driver for outputting the data received from the local dimming driver to the liquid crystal panel; and a backlight driver for controlling luminance of the backlight unit on a local dimming block basis according to the local dimming value of each local dimming block received from the local dimming driver, wherein the method for dividing a display area for local dimming, comprises:

determining an initial number of pixels per data analysis area and a total number of residual pixels using a resolution of the display area and a total number of data analysis areas equal to a total number of local dimming areas of a backlight unit;

calculating a first residual pixel sum of a current data analysis area by adding the total number of residual pixels to a second residual pixel sum of a previous data analysis area, each time a data analysis area index increases;

comparing the first residual pixel sum of the current data analysis area with the total number of data analysis areas and determining whether to assign a residual pixel to the current data analysis area according to a result of the comparison;

calculating a second residual sum of the current data analysis area by subtracting the total number of data analysis areas from the first residual pixel sum of the current data analysis area and outputting the second residual sum of the current data analysis area as the second residual sum of the previous data analysis area for a next data analysis area, if a residual pixel is assigned to the current data analysis area;

setting the first residual sum of the current data analysis area as the second residual sum of the current data analysis area and outputting the second residual sum of the current data analysis area as the second residual sum of the previous data analysis area for the next data analysis area, if a residual pixel is not assigned to the current data analysis area; and repeating the calculation of a first residual pixel sum of a current data analysis area, the determination as to whether to assign a residual pixel to the current data analysis area, and the outputting of a second residual pixel sum of the current data analysis area, until the data analysis area index is a last data analysis area index wherein the determination of an initial number of pixels per data analysis area and a total number of residual pixels comprises:

determining an integer obtained by diving the resolution by the total number of data analysis areas as the initial number of pixels per data analysis area; and determining the total number of residual pixels by calculating "the resolution-(the initial number of pixels per data analysis area)×(the total number of data analysis areas)".

16. The device according to claim 15, wherein if the backlight unit is driven in parallel through a plurality of ports, the determination of the total number of residual pixels comprises determining the total number of residual pixels by calculating "(the resolution/a number of the ports)−(the initial number of pixels per data analysis area)×(the total number of data analysis areas)".

17. The device according to claim 16, wherein the calculation of a first residual pixel sum of a current data analysis area comprises calculating the first residual pixel sum of the current data analysis area by adding the total number of residual pixels to the second residual pixel sum of the previous data analysis area.

18. The device according to claim 17, wherein the determination as to whether to assign a residual pixel to the current data analysis area comprises:

distributing one residual pixel to the current data analysis area, if the first residual pixel sum of the current data analysis area is larger than the total number of data analysis areas; and determining a final number of pixels in the current data analysis area by adding one to the initial number of pixels per data analysis areas.

19. The device according to claim 18, wherein the determination as to whether to assign a residual pixel to the current data analysis area further comprises:

determining the final number of pixels in the current data analysis as the initial number of pixels per data analysis areas without assigning a residual pixel to the current data analysis area, if the first residual pixel sum of the current data analysis area is equal to or smaller than the total number of data analysis areas.

20. The device according to claim 19, wherein the determination of an initial number of pixels per data analysis area and a total number of residual pixels, the calculation of a first residual pixel sum of a current data analysis area, the determination as to whether to assign a residual pixel to the current data analysis area, the outputting of a second residual pixel sum of the current data analysis area, and the repetition are performed for each of horizontal and vertical resolutions of the resolution of the display area.

21. The device according to claim 20, wherein one residual pixel is assigned to each of as many data analysis areas as the total number of residual pixels, among the data analysis areas.

* * * * *